US007334842B1

(12) United States Patent
Wu

(10) Patent No.: US 7,334,842 B1
(45) Date of Patent: Feb. 26, 2008

(54) CHAIR WITH MOVABLE SEAT

(76) Inventor: Chin-Hu Wu, No. 326, Section 3, Chung Kong Road, Taichung 407 (TW)

( * ) Notice: Subject to any disclaimer, the term of this patent is extended or adjusted under 35 U.S.C. 154(b) by 0 days.

(21) Appl. No.: 11/711,412

(22) Filed: Feb. 27, 2007

(51) Int. Cl.
*A47C 1/00* (2006.01)

(52) U.S. Cl. ..... 297/313; 297/337

(58) Field of Classification Search ..... 297/313, 297/261.3, 261.2, 261.1, 318, 440.22, 311, 297/258.1, 338, 337
See application file for complete search history.

(56) References Cited

U.S. PATENT DOCUMENTS

| | | | | |
|---|---|---|---|---|
| 301,913 | A * | 7/1884 | Miller | 297/313 |
| 809,944 | A * | 1/1906 | Hanger | 297/342 |
| 2,310,346 | A * | 2/1943 | Bell | 248/408 |
| 2,925,122 | A * | 2/1960 | Winick | 297/318 |
| 3,022,037 | A * | 2/1962 | Stallard | 248/421 |
| 3,563,600 | A * | 2/1971 | Converse | 297/254 |
| 3,655,239 | A * | 4/1972 | Agosti | 297/331 |
| 4,761,036 | A * | 8/1988 | Vogel | 297/452.18 |
| 5,622,406 | A * | 4/1997 | Meschkat et al. | 297/318 |
| 6,814,411 | B1 * | 11/2004 | Lin | 297/440.22 |
| 2003/0132655 | A1 * | 7/2003 | Gamble | 297/338 |

* cited by examiner

*Primary Examiner*—Milton Nelson, Jr.
(74) *Attorney, Agent, or Firm*—Charles E. Baxley

(57) ABSTRACT

A chair includes a base which includes two facing sides and each of the facing sides has two grooves and both of which extend in a horizontal direction and a vertical direction. A seat has four engaging members which are movably engaged with the four grooves in the two facing sides of the base so that the seat can be moved in horizontal and vertical directions relative to the base.

5 Claims, 7 Drawing Sheets

CHAIR WITH MOVABLE SEAT

FIELD OF THE INVENTION

The present invention relates to a chair with a seat which is allowed to be pivoted back and forth inclinedly.

BACKGROUND OF THE INVENTION

A conventional chair with a pivotable seat is shown in FIG. 1 and generally includes a base 80 which includes a horizontal top board 81 and a plurality of flexible pillows 70 connected to the top board 81. A seat 90 includes a top surface 91 and a bottom surface 92, the pillows 70 are connected between the top board 81 and the bottom surface 92 of the seat 90. The two ends of the seat 90 can be pivoted up and down by deforming the pillows 70. Although the conventional chair shown in FIG. 1 provides a pivotable seat which allows the user to change the pose when sitting in the chair, the seat 90 cannot move so that the user has to move his or her body to find out a comfortable pose.

The present invention intends to provide a chair which has a movable seat so that the user can change different poses while the seat is moved with the user's body movement.

SUMMARY OF THE INVENTION

The present invention relates to a chair comprising a base and a seat which is movably connected to the base. The base has two facing sides and a first groove and a second groove are defined in each of the two facing sides respectively. Both of the first and second grooves extend in a horizontal direction and a vertical direction. A first opening and a second opening are respectively defined in a top edge of each of the two facing sides and communicate with the first groove and the second groove respectively. The seat has four engaging members which are movably engaged with the first and second grooves via the first and second openings.

The primary object of the present invention is to provide a chair with a seat which is movable relative to the base and is guided by grooves defined in the base.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
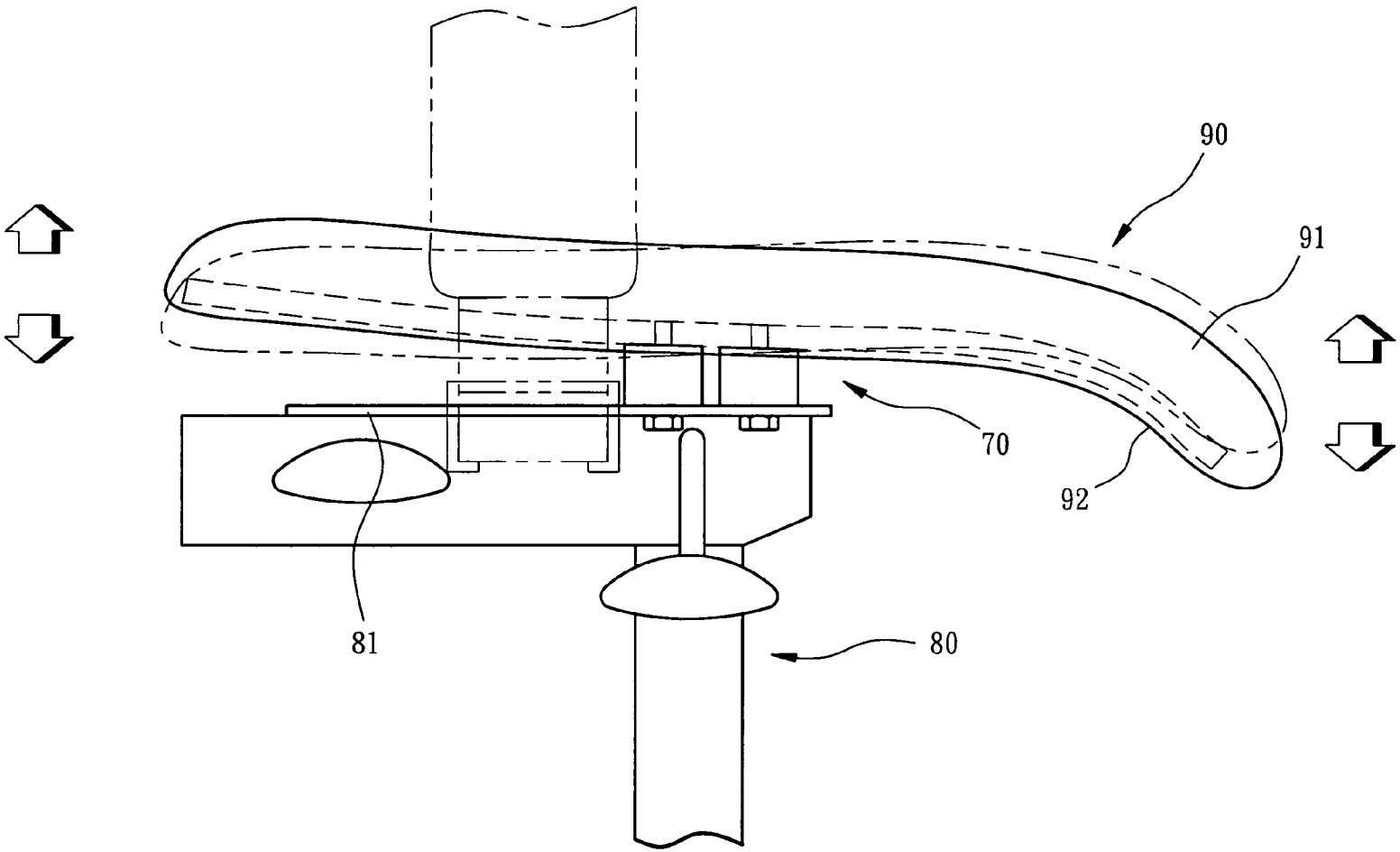
FIG 1 PRIOR ART
FIG. 1 is a side view to show a conventional chair with a pivotable seat.
Figure 2:
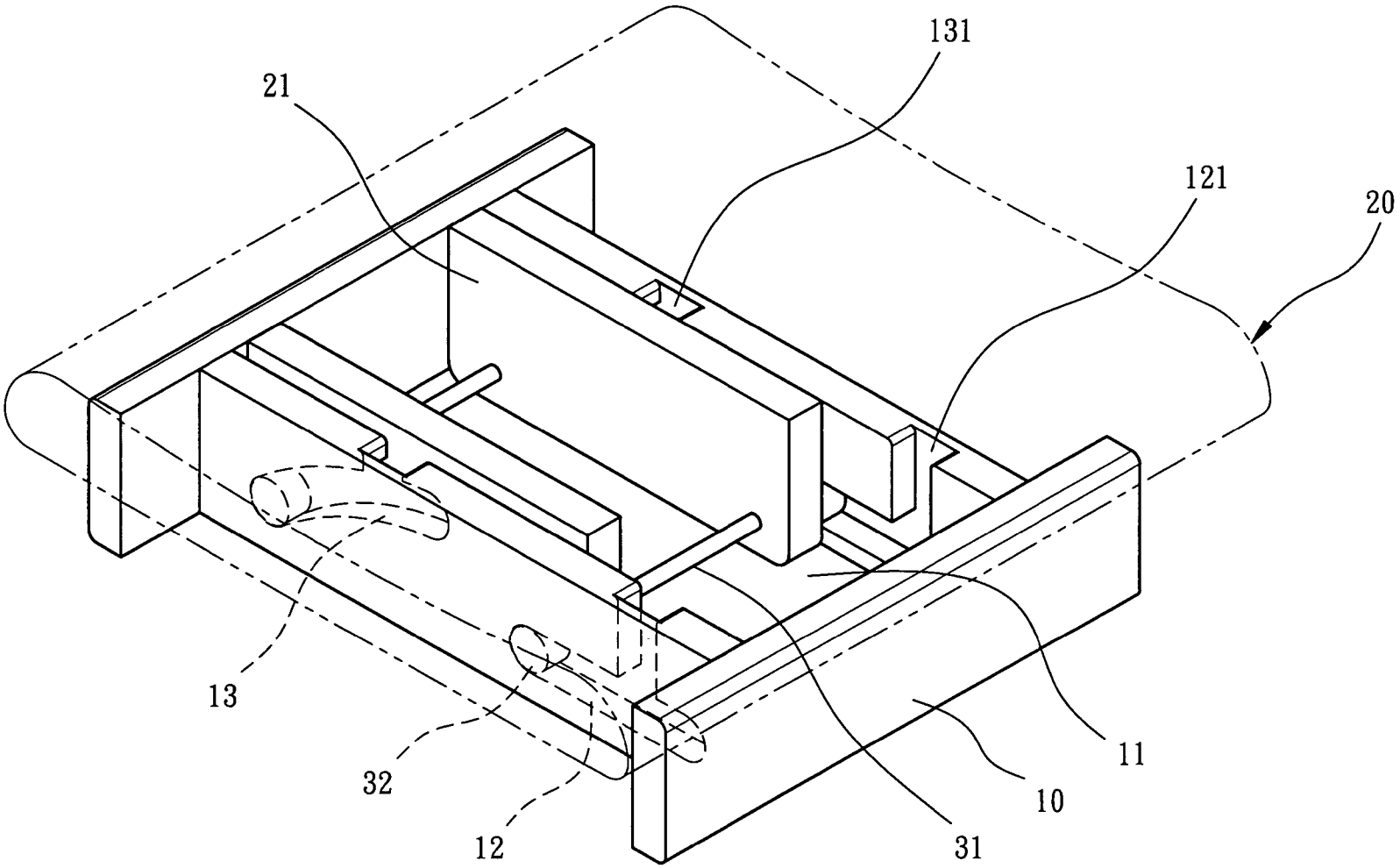
FIG. 2 shows the base with the seat (dotted lines) connected to the base of the chair of the present invention.
Figure 3:
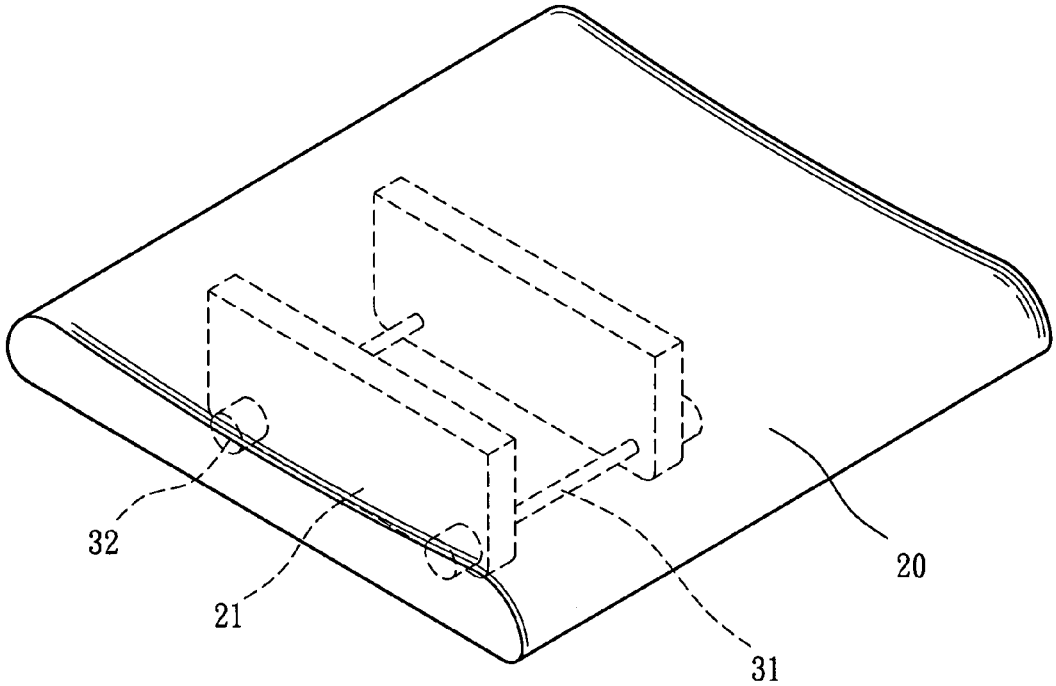
FIG. 3 is an exploded view to show the chair of the present invention.
Figure 3:
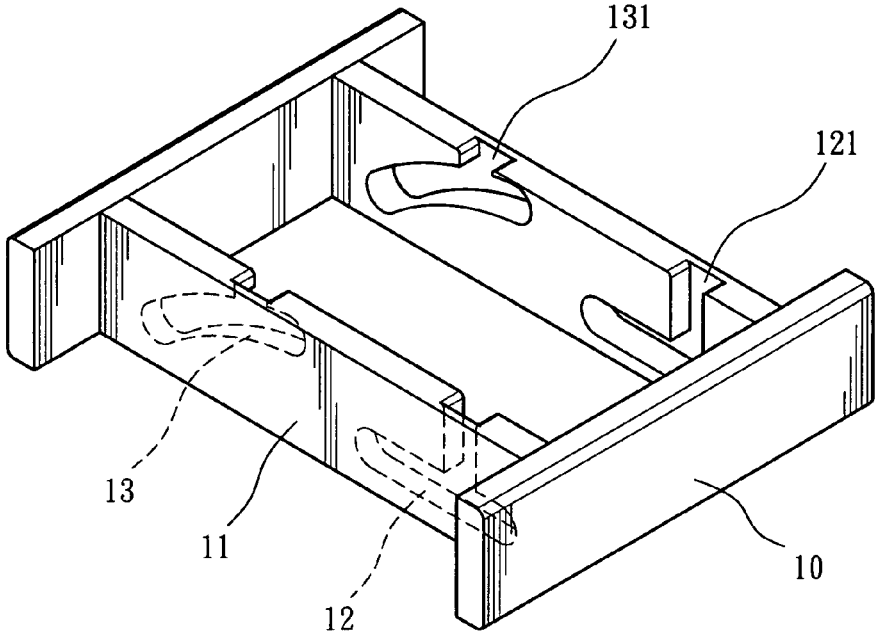
Figure 4:
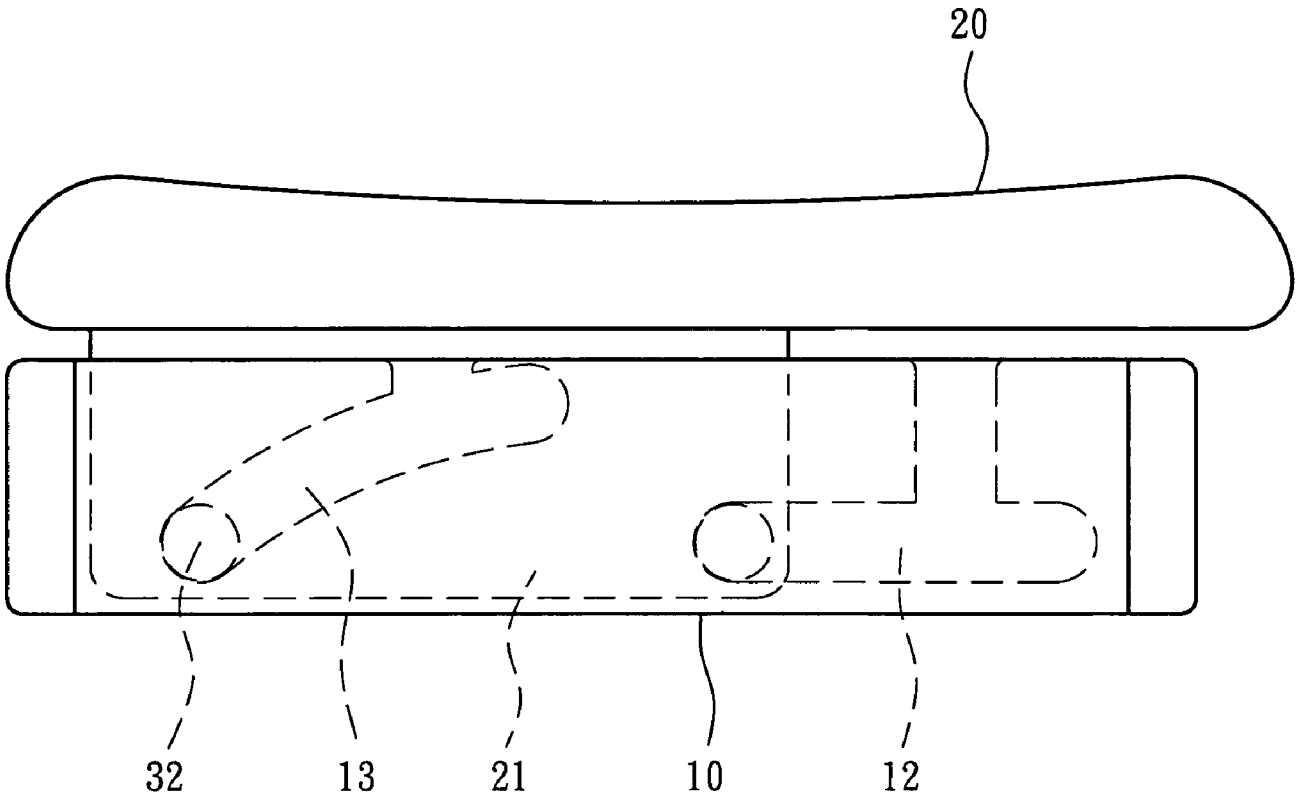
FIG. 4 shows that the engaging members of the seat are located in the grooves in the base.

Referring to FIGS. 2 to 4, the chair of the present invention comprises a base 10 and a seat 20, wherein the base 10 includes two facing sides 11 and two end boards between which the tow facing sides 11 are connected. A first groove 12 and a second groove 13 are defined in each of the two facing sides 11 and extend in a horizontal direction and a vertical direction. A first opening 121 and a second opening 131 are respectively defined in a top edge of each of the two facing sides 11 and communicate with the first groove 12 and the second groove 13 respectively. The first groove 12 is an inverted T-shaped groove and includes a vertical sub-groove and a horizontal groove. The vertical sub-groove communicates with the first opening 121. The second groove 13 is an inclined groove.

Figure 7:
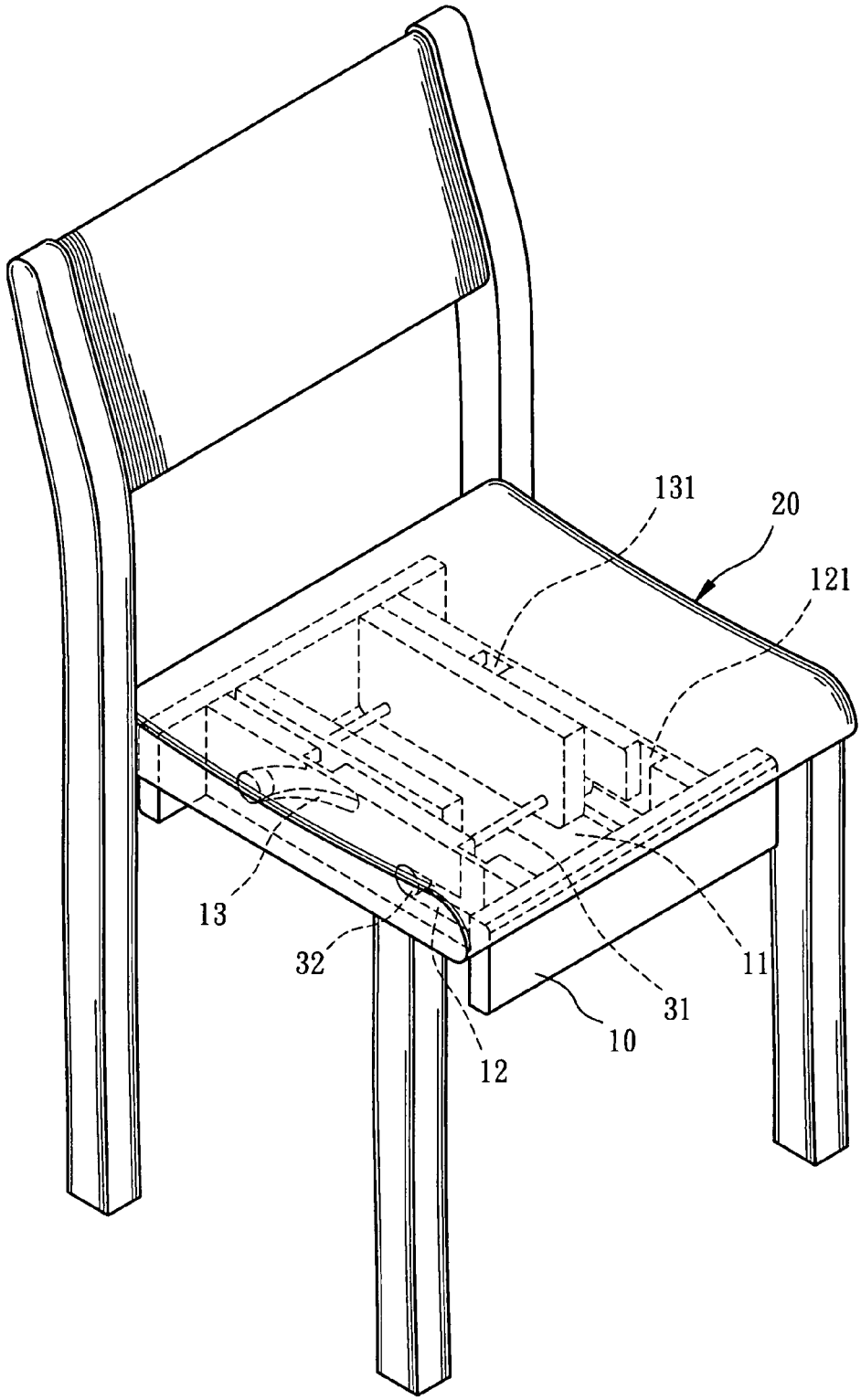
FIG. 7 shows the chair with backrest and four legs.

The seat 20 has two ridges 21 connected to an underside thereof and two links 31 are connected between the two ridges 21. Each of the two ridges 21 has two engaging members 32 extending from an outside thereof. The engaging members 32 are cylindrical members in the embodiment and movably engaged with the first and second grooves 12, 13 via the first and second openings 121, 131. FIG. 7 shows that the chair may include a backrest and four legs.

Figure 6:
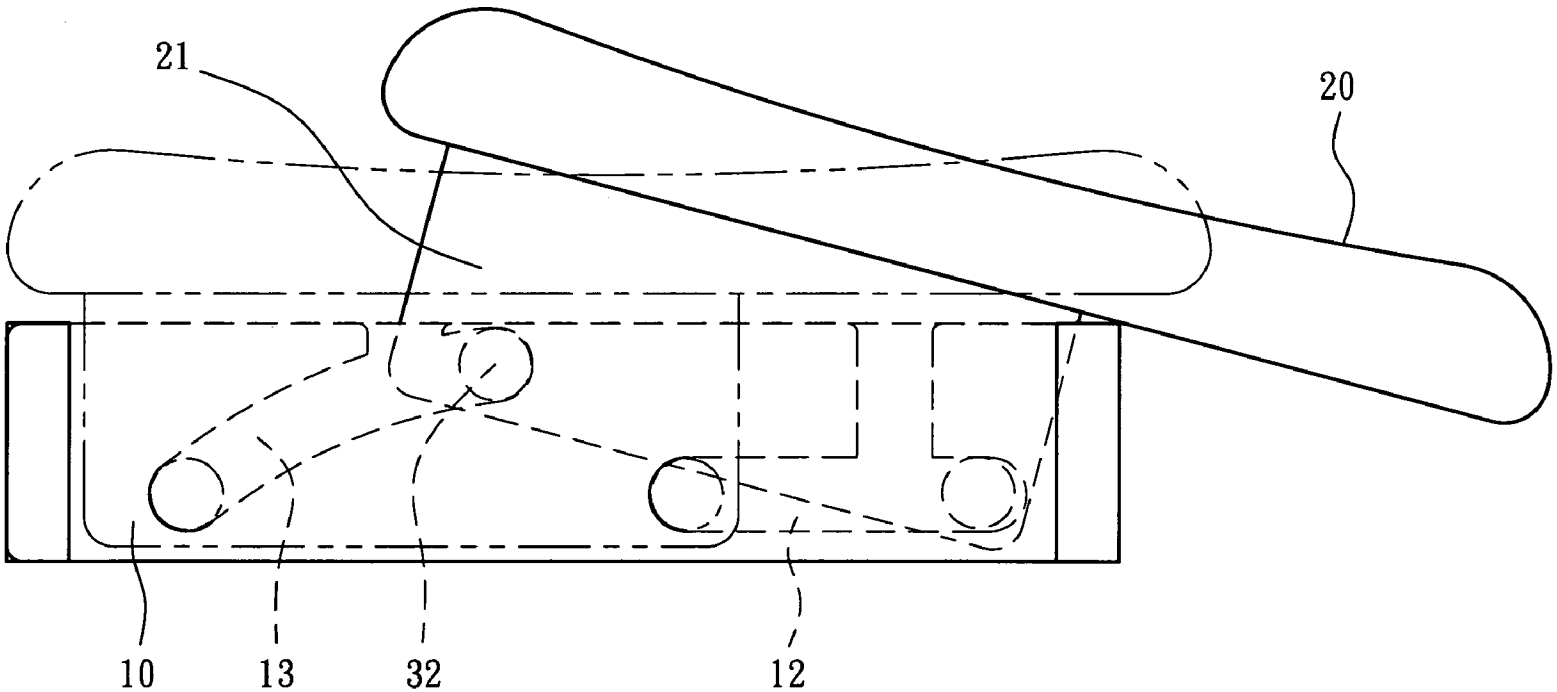
FIG. 6 shows the seat is moved forward.

As shown in FIG. 6, the seat 20 can be moved relative to the base 10 along the first and second grooves 12, 13. When the engaging members 32 are located at the lower end of the second groove 13 and the first grooves 12 as shown in FIG. 4, the seat 20 is in a horizontal position.

Figure 5:
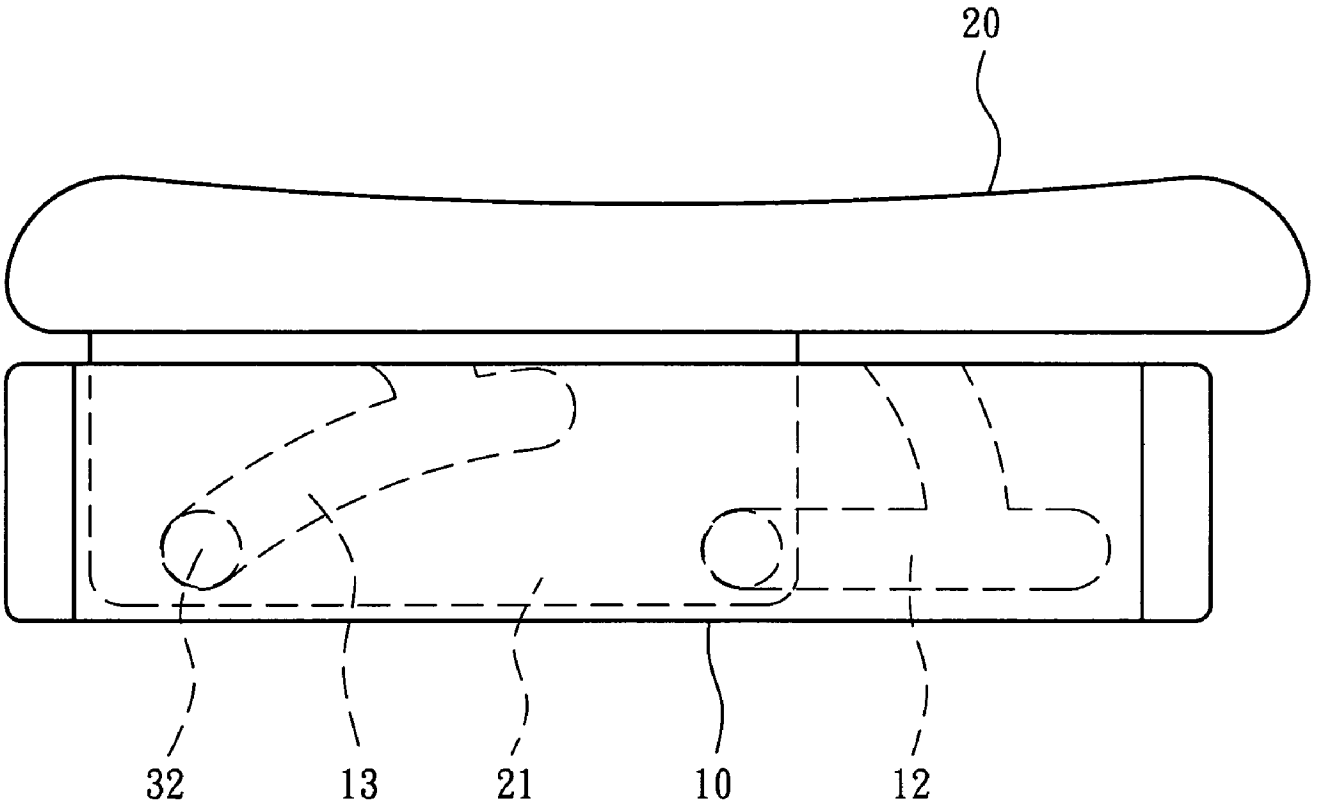
FIG. 5 shows another embodiment of the first grooves in the base of the chair of the present invention.

FIG. 5 shows another embodiment of the first grooves 12 in the base 10 of the chair of the present invention, wherein the vertical sub-section in FIG. 4 is replaced with an inclined sub-groove and the inclined sub-groove communicates with the first opening 121.

While we have shown and described the embodiment in accordance with the present invention, it should be clear to those skilled in the art that further embodiments may be made without departing from the scope of the present invention.

What is claimed is:

1. A chair comprising:

a base having two facing sides, a first groove and a second groove defined in each of the two facing sides and extending in a horizontal direction and a vertical direction, the first groove including an inclined sub-groove and a horizontal sub-groove, a first opening and a second opening respectively defined in a top edge of each of the two facing sides and communicating with the inclined sub-groove of the first groove and the second groove respectively, and a seat having four engaging members which are movably engaged with the first and second grooves via the first and second openings.

2. The chair as claimed in claim 1, wherein the first groove is an inverted T-shaped groove.

3. The chair as claimed in claim 1, wherein the second groove is an inclined groove.

4. The chair as claimed in claim 1, wherein the seat has two ridges connected to an underside thereof and two links are connected between the two ridges, each of the two ridges has two engaging members extending from an outside thereof.

5. The chair as claimed in claim 4, wherein the engaging members are cylindrical members.

* * * * *